US006263085B1

(12) United States Patent
Weffer

(10) Patent No.: US 6,263,085 B1
(45) Date of Patent: Jul. 17, 2001

(54) SURROUND SOUND HEADPHONES

(76) Inventor: Sergio W. Weffer, 670 W. 200 South, Provo, UT (US) 84601

( * ) Notice: Subject to any disclaimer, the term of this patent is extended or adjusted under 35 U.S.C. 154(b) by 0 days.

(21) Appl. No.: 09/345,846

(22) Filed: Jul. 1, 1999

(51) Int. Cl.[7] ..... H04R 25/00

(52) U.S. Cl. ..... 381/371; 379/430; 381/374; 381/376; 381/186; 381/370

(58) Field of Search ..... 381/307, 309, 381/310, 370, 371, 376, 384, 184, 182, 394, 395, 99; 379/430

(56) References Cited

U.S. PATENT DOCUMENTS 3,943,304 * 3/1976 Piribauer ..... 179/105
3,984,885 * 10/1976 Yoshimura ..... 179/156 R
4,173,715 * 11/1979 Gosman ..... 179/156 R
5,680,465 * 10/1997 Boyden ..... 381/25

* cited by examiner

*Primary Examiner*—Curtis Kuntz
*Assistant Examiner*—Dionne N. Harvey

(57) ABSTRACT

A surround sound headphones for enhancing a wearer's listening experience by providing a surround sound speaker configuration therein. The surround sound headphones includes a headband for wear on a user's head and a pair of earpieces coupled to the headband. Each of the earpieces has an open inner face which defines a cavity in the respective earpiece. Each earpiece may also have a generally circular shaped fabric covered shield covering the open inner face of the respective earpiece. The inner face of each of the earpieces has a center extent extending into the cavity of the respective earpiece. The center extent has a plurality of side faces each having at least one speaker mounted thereto.

8 Claims, 2 Drawing Sheets

SURROUND SOUND HEADPHONES

BACKGROUND OF THE INVENTION

1. Field of the Invention

The present invention relates to headphones and more particularly pertains to a new surround sound headphones for enhancing a wearer's listening experience by providing a surround sound speaker configuration therein.

2. Description of the Prior Art

The use of headphones is known in the prior art. More specifically, headphones heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,796,840; U.S. Pat. No. 5,661,812; U.S. Pat. No. 5,371,799; U.S. Pat. No. 5,333,206; U.S. Pat. No. Des. 376,362; and U.S. Pat. No. Des. 353,818 which are incorporated herein by reference to the extent necessary for understanding the present invention.

While these devices fulfill their respective, particular objectives and requirements, the aforementioned patents do not disclose a new surround sound headphones. The inventive device includes a headband for wear on a user's head and a pair of earpieces coupled to the headband. Each of the earpieces has an open inner face which defines a cavity in the respective earpiece. Each earpiece may also have a generally circular shaped fabric covered shield covering the open inner face of the respective earpiece. The inner face of each of the earpieces has a center extent extending into the cavity of the respective earpiece. The center extent has a plurality of side faces each having at least one speaker mounted thereto.

In these respects, the surround sound headphones according to the present invention substantially departs from the conventional concepts and designs of the prior art, and in so doing provides an apparatus primarily developed for the purpose of enhancing a wearer's listening experience by providing a surround sound speaker configuration therein.

SUMMARY OF THE INVENTION

In view of the foregoing disadvantages inherent in the known types of headphones now present in the prior art, the present invention provides a new surround sound headphones construction wherein the same can be utilized for enhancing a wearer's listening experience by providing a surround sound speaker configuration therein.

The general purpose of the present invention, which will be described subsequently in greater detail, is to provide a new surround sound headphones apparatus and method which has many of the advantages of the headphones mentioned heretofore and many novel features that result in a new surround sound headphones which is not anticipated, rendered obvious, suggested, or even implied by any of the prior art headphones, either alone or in any combination thereof.

To attain this, the present invention generally comprises a headband for wear on a user's head and a pair of earpieces coupled to the headband. Each of the earpieces has an open inner face which defines a cavity in the respective earpiece. The inner face of each of the earpieces has a center extent extending into the cavity of the respective earpiece. The center extent has a plurality of side faces each having at least one speaker mounted thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new surround sound headphones apparatus and method which has many of the advantages of the headphones mentioned heretofore and many novel features that result in a new surround sound headphones which is not anticipated, rendered obvious, suggested, or even implied by any of the prior art headphones, either alone or in any combination thereof.

It is another object of the present invention to provide a new surround sound headphones which may be easily and efficiently manufactured and marketed.

It is a further object of the present invention to provide a new surround sound headphones which is of a durable and reliable construction.

An even further object of the present invention is to provide a new surround sound headphones which is susceptible of a low cost of manufacture with regard to both materials and labor, and which accordingly is then susceptible of low prices of sale to the consuming public, thereby making such surround sound headphones economically available to the buying public.

Still yet another object of the present invention is to provide a new surround sound headphones which provides in the apparatuses and methods of the prior art some of the advantages thereof, while simultaneously overcoming some of the disadvantages normally associated therewith.

Still another object of the present invention is to provide a new surround sound headphones for enhancing a wearer's listening experience by providing a surround sound speaker configuration therein.

Yet another object of the present invention is to provide a new surround sound headphones which includes a headband for wear on a user's head and a pair of earpieces coupled to the headband. Each of the earpieces has an open inner face which defines a cavity in the respective earpiece. The inner face of each of the earpieces has a center extent extending into the cavity of the respective earpiece. The center extent has a plurality of side faces each having at least one speaker mounted thereto.

Still yet another object of the present invention is to provide a new surround sound headphones that makes a wearer experience sound that appears to be coming from in front of, behind, above, and below the wearer to thereby further enhance the wearer's listening enjoyment and realism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
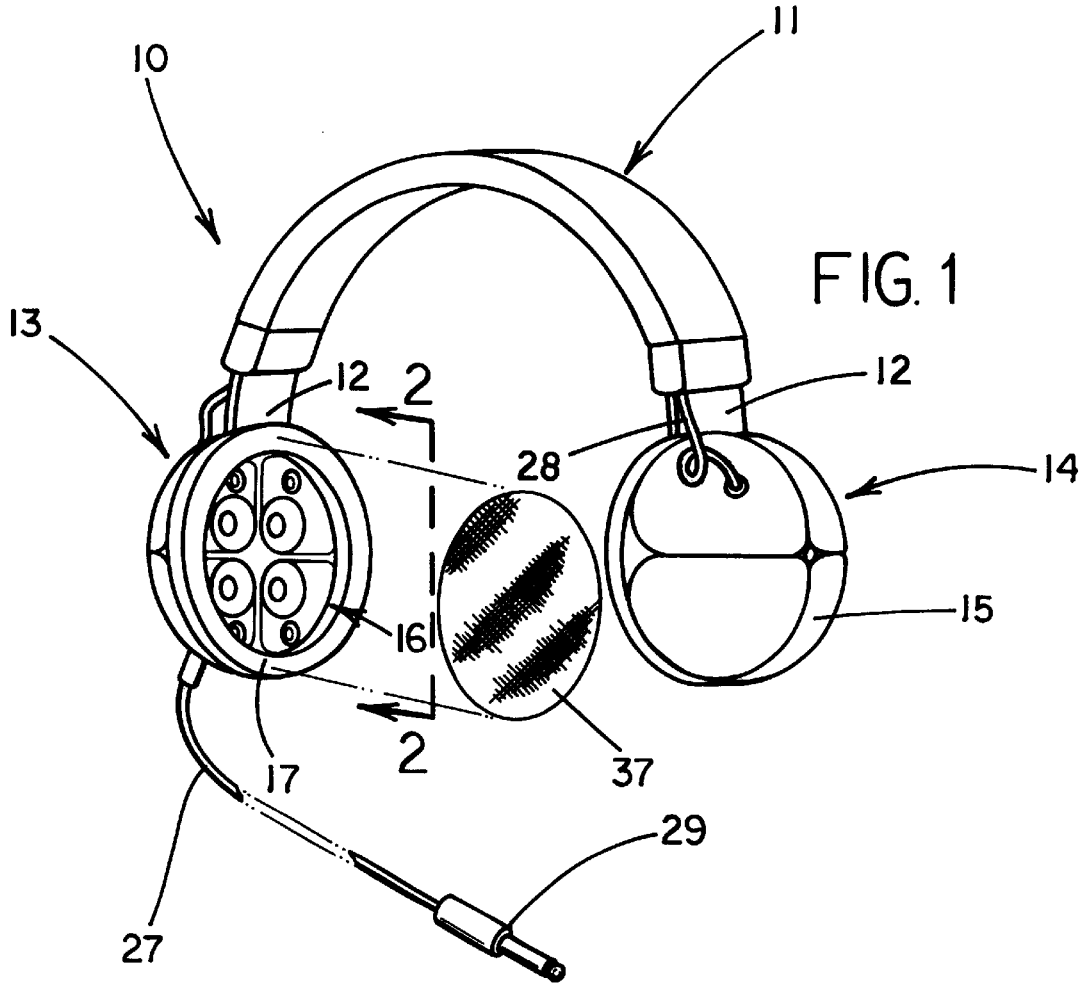
FIG. 1 is a schematic perspective view of a new surround sound headphones according to the present invention.
Figure 2:
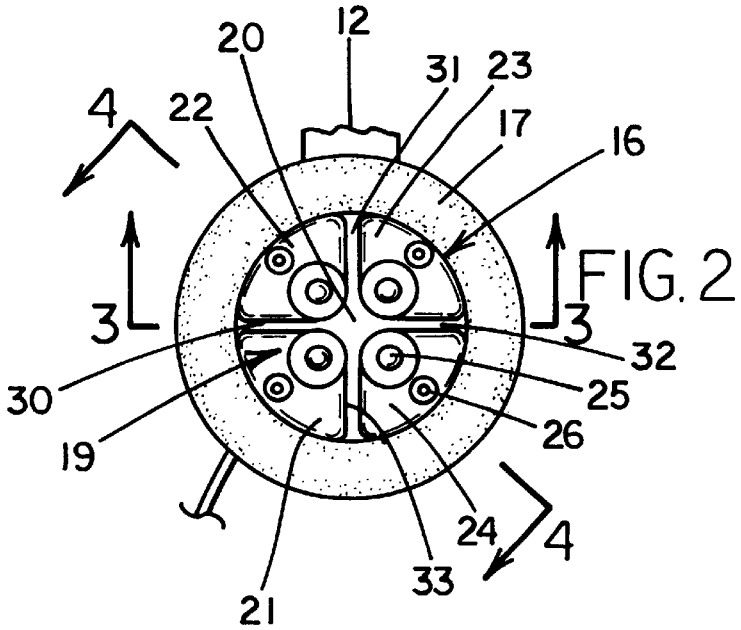
FIG. 2 is a schematic side view of an inner face of an earpiece of the present invention taken from the vantage of line 2—2 of FIG. 1.

With reference now to the drawings, and in particular to FIGS. 1 through 4 thereof, a new surround sound headphones embodying the principles and concepts of the present invention and generally designated by the reference numeral 10 will be described.

As best illustrated in FIGS. 1 through 4, the surround sound headphones 10 generally comprises a headband for wear on a user's head and a pair of earpieces coupled to the headband. Each of the earpieces has an open inner face which defines a cavity in the respective earpiece. Each earpiece may also have a generally circular shaped fabric covered shield covering the open inner face of the respective earpiece. The inner face of each of the earpieces has a center extent extending into the cavity of the respective earpiece. The center extent has a plurality of side faces each having at least one speaker mounted thereto.

In use, the surround sound headphones are designed for electrically connecting to an audio system for generating sounds therefrom to create a surround sound audio experience. Specifically, the surround sound headphones 10 includes an arcuate headband 11 which is designed for wear on a user's head and has a pair of opposite ends. Each end of the headband may have a telescopically extendable portion 12 to permit selective adjustment of the overall length of the headband.

The headphones also includes a pair of earpieces 13,14. One of the earpieces housings is coupled to one of the ends of the headband and the other of the earpieces is coupled to the other of the ends of the headband. Each of the earpieces may have a generally dome-shaped outer face 15 and an open inner face 16. The inner faces of the earpieces face each other. Each earpiece may also have a generally circular shaped fabric covered shield 37 covering the open inner face of the respective earpiece. The inner face of one of the earpieces is designed for placement over one ear of the user and the inner face of the other of the earpieces is designed for placement over another ear of the user.

In one embodiment, each of the earpieces may have a resiliently deformable annular earpad 17 around a generally circular outer periphery 18 of the inner face of the respective earpiece. In one such embodiment, the annular earpads each may comprise a resiliently deformable foamed material.

Figure 3:
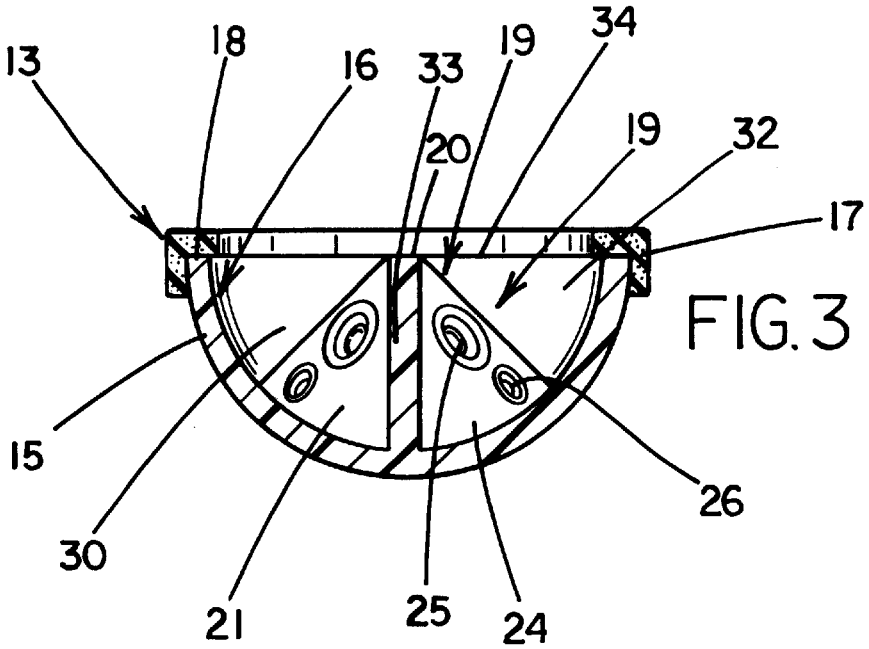
FIG. 3 is a schematic cross sectional view of an earpiece taken from line 3—3 of FIG. 2.
Figure 4:
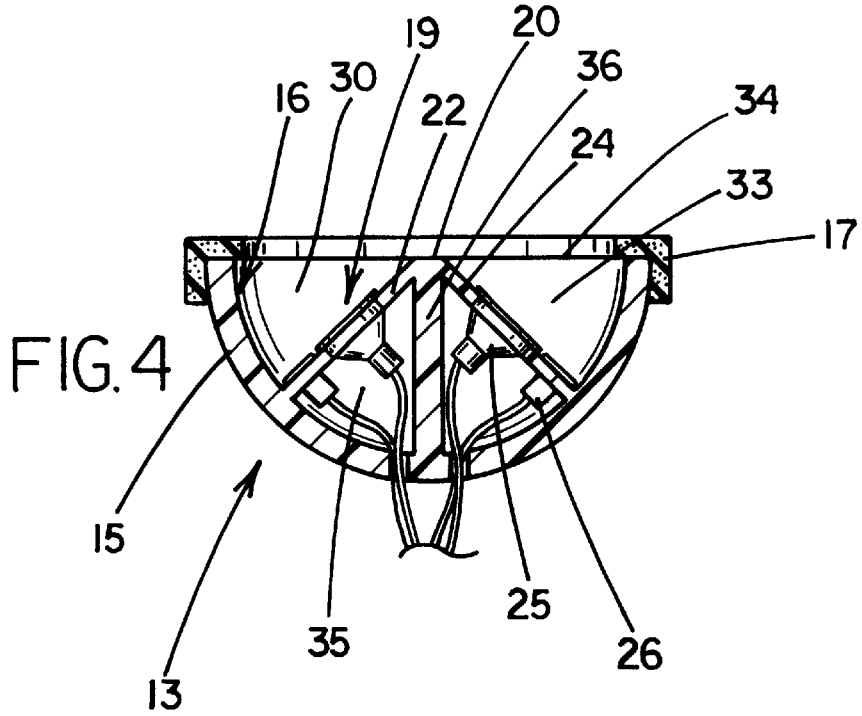
FIG. 4 is a schematic cross sectional view of an earpiece taken from line 4—4 of FIG. 2.

As best illustrated in FIGS. 3 and 4, the inner faces of the earpieces each define a generally hemispherical concave cavity in the respective earpiece. The inner face of each of the earpieces has a generally pyramidal center extent 19 extending into the cavity of the respective earpiece. The center extent of each earpiece has a vertex 20 extending towards a plane in which the outer periphery of the inner face of the respective earpiece lies. In one embodiment, the vertex may actually lie in a common plane with the outer periphery of the inner face.

The center extent of each earpiece also has four generally triangular side faces 21,22,23,24. Each of the side faces of the center extent of each earpiece has a pair of speakers 25,26 mounted thereto. In one embodiment, each pair of speakers may include a woofer-type speaker 25 and a tweeter-type speaker 26.

The speakers of each earpiece are electrically connectable to an audio system so that the speakers may generate audible sounds corresponding to signals received by the speakers from the audio system. In one embodiment, the speakers of each earpiece may have circuitry and wiring arranged to interact with a surround sound component of the audio system such that the speakers of each face emit sounds corresponding to in a manner to simulate surround sound as generated by the surround sound system. For example, the speakers of a first of the side faces of each earpiece are configured to emit sounds simulating sounds coming from in front of the wearer, the speakers of a second of the side faces of each earpiece are configured to emit sounds simulating sounds coming from behind the wearer, the speakers of a third of the side faces of each earpiece are configured to emit sounds simulating sounds coming from above of the wearer, and the speakers of a fourth of the side faces of each earpiece are configured to emit sounds simulating sounds coming from below the wearer.

In one embodiment, an elongate flexible cable 27 is outwardly extended from one of the earpieces. The speakers of both earpieces are electrically connected to the cable with the speakers of the other earpiece is connected via a second cable 28 extending between the earpieces and through the headband. The cable 27 has a free end with a plug 29 for inserting into a socket of the audio system to electrically connect the cable and speakers to the audio system.

In one embodiment, the center extents each has four outwardly radiating baffles 30,31,32,33 extending to the inner surface of the respective earpiece. Each of the baffles of each center extent is outwardly extended from a corresponding side edge of the center extent which is positioned between a pair of adjacent associated faces of the respective center extent. As illustrated in the Figures, the baffles divide the cavity of the respective earpiece into four compartments with one side face of the respective center extent located in each of the compartments.

In one such embodiment, each of the baffles may have a substantially straight upper edge 34 extending between the vertex of the respective center extent and the outer perimeter of the inner face of the respective earpiece such that the upper edges of the baffles lie in a common plane with the outer perimeter of the inner face of the respective earpiece. This way, the baffles sonically isolate each of the compartments from one another when the earpieces are worn over the ears of the user to thereby impart a surround sound quality to the sounds generated by the speakers.

In an optional embodiment, as shown in FIGS. 3 and 4, each of the center extents has a hollow interior 35 and has a center post 36 extending from a center of the inner face of the respective earpiece to the inside of the vertex of the respective center extent. The hollow interior helps enhance acoustic resonance for the speakers and the center post provides structural support to the center extent.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Headphones for electrically connecting to an audio system for generating sounds therefrom, said headphones comprising:

an arcuate headband being adapted for wear on a user's head and having a pair of opposite ends;

a pair of earpieces, one of said earpieces housings being coupled to one of said ends of said headband, and the other of said earpieces being coupled to the other of said ends of said headband;

each of said earpieces having a generally dome-shaped outer face and an open inner face, said inner faces of said earpieces facing each other;

each earpiece having a generally circular shaped fabric covered shield covering the open inner face of the respective earpiece;

said inner face of one of said earpieces being adapted for placement over one ear of the user and said inner face of the other of said earpieces being adapted for placement over another ear of the user;

each of said earpieces having a deformable annular earpad around a generally circular outer periphery of said inner face of the respective earpiece;

said inner faces of said earpieces each defining a generally hemispherical concave cavity in the respective earpiece;

said inner face of each of said earpieces having a generally pyramidal center extent extending into said cavity of the respective earpiece, said center extent of each earpiece having a vertex extending towards a plane in which said outer periphery of said inner face of the respective earpiece lies;

said center extent of each earpiece having four generally triangular side faces;

each of said side faces of said center extent of each earpiece having a pair of speakers mounted thereto, wherein each pair of speakers comprises a woofer-type speaker and a tweeter-type speaker;

said center extents each having four outwardly radiating baffles extending to said inner surface of the respective earpiece;

each of said baffles of each center extent being positioned between a pair of adjacent associated faces of the respective center extent;

said baffles dividing said cavity of the respective earpiece into four compartments with one side face of the respective center extent located in each of said compartments; and each of said baffles having a substantially straight upper edge extending between said vertex of the respective center extent and said outer perimeter of said inner face of the respective earpiece such that said upper edges of said baffles lie in a common plane with said outer perimeter of said inner face of the respective earpiece.

2. Headphones for electrically connecting to an audio system for generating sounds therefrom, said headphones comprising:

an arcuate headband being adapted for wear on a user's head and having a pair of opposite ends;

a pair of earpieces, one of said earpieces housings being coupled to one of said ends of said headband, and the other of said earpieces being coupled to the other of said ends of said headband;

each of said earpieces having a dome-shaped outer face and an open inner face, said inner faces of said earpieces facing each other;

each earpiece having a circular shaped fabric covered shield covering the open inner face of the respective earpiece;

said inner face of one of said earpieces being adapted for placement over one ear of the user and said inner face of the other of said earpieces being adapted for placement over another ear of the user;

each of said earpieces having a deformable annular earpad around a circular outer periphery of said inner face of the respective earpiece;

said inner faces of said earpieces each defining a hemispherical concave cavity in the respective earpiece;

said inner face of each of said earpieces having a pyramidal center extent extending into said cavity of the respective earpiece, said center extent of each earpiece having a vertex extending towards a plane in which said outer periphery of said inner face of the respective earpiece lies;

said center extent of each earpiece having four triangular side faces;

each of said side faces of said center extent of each earpiece having at least one speaker mounted thereto;

said center extents each having four outwardly radiating baffles extending to said inner surface of the respective earpiece;

each of said baffles of each center extent being positioned between a pair of adjacent associated faces of the respective center extent;

said baffles dividing said cavity of the respective earpiece into four compartments with one side face of the respective center extent located in each of said compartments; and each of said baffles having a substantially straight upper edge extending between said vertex of the respective center extent and said outer perimeter of said inner face of the respective earpiece such that said upper edges of said baffles lie in a common plane with said outer perimeter of said inner face of the respective earpiece.

3. Headphones, comprising:

a headband for wear on a user's head;

a pair of earpieces coupled to said headband;

each of said earpieces having an open inner face;

said inner faces of said earpieces each defining a cavity in the respective earpiece;

said inner face of each of said earpieces having a center extent extending into said cavity of the respective earpiece, said center extent of each earpiece having a vertex, and a plurality of side faces; each of said side faces of said center extent of each earpiece having at least one speaker mounted thereto; and wherein each of said side faces of said center extent is triangular shaped such that said center extent is divided into at least four sections.

4. The headphones of claim 3, wherein each of said earpieces has a deformable annular earpad around an outer periphery of said inner face of the respective earpiece.

5. The headphones of claim 3, wherein each of said side faces of said center extent of each earpiece having a pair of speakers mounted thereto.

6. The headphones of claim 5, wherein each pair of speakers comprises a woofer-type speaker and a tweeter-type speaker.

7. The headphones of claim 3, wherein said center extents each have a plurality of outwardly radiating baffles extending to said inner surface of the respective earpiece, each of said baffles of each center extent being positioned between a pair of adjacent associated faces of the respective center extent, said baffles dividing said cavity of the respective earpiece into a corresponding plurality of compartments with one side face of the respective center extent located in each of said compartments.

8. The headphones of claim 5, wherein each of said baffles having an upper edge extending between said vertex of the respective center extent and an outer perimeter of said inner face of the respective earpiece such that said upper edges of said baffles lie in a common plane with said outer perimeter of said inner face of the respective earpiece.

* * * * *